United States Patent [19]

Smith

[11] Patent Number: 5,029,501

[45] Date of Patent: Jul. 9, 1991

[54] ROUGHING CUTTER FOR SAW CHAIN

[76] Inventor: Wayne A. Smith, Box 44, Remsen, N.Y. 13438

[21] Appl. No.: 551,064

[22] Filed: Jul. 11, 1990

Related U.S. Application Data

[63] Continuation-in-part of Ser. No. 462,757, Jan. 10, 1990, abandoned.

[51] Int. Cl.[5] ..... B27B 33/14

[52] U.S. Cl. ..... 83/13; 83/830; 83/834

[58] Field of Search ..... 83/830, 831, 832, 833, 83/834, 852, 853, 835, 848, 13; 30/381

[56] References Cited

U.S. PATENT DOCUMENTS

| | | | |
|---|---|---|---|
| 2,655,958 | 10/1953 | Gommel | 83/834 |
| 2,798,517 | 7/1957 | Carney | 83/830 |
| 2,905,209 | 9/1959 | Gudmundsen | 83/834 |
| 3,040,789 | 6/1962 | Mall et al. | 83/833 |
| 3,376,906 | 4/1968 | Gasner | 83/830 |
| 3,727,507 | 4/1973 | Weiss | 83/831 |
| 4,211,136 | 7/1980 | Geurian | 83/830 |
| 4,463,645 | 8/1984 | Goellner | 83/852 |
| 4,813,323 | 3/1989 | Harfst | 83/830 |

FOREIGN PATENT DOCUMENTS

| | | | |
|---|---|---|---|
| 0277216 | 12/1987 | Japan | 83/835 |

*Primary Examiner*—Frank T. Yost
*Assistant Examiner*—Eugenia A. Jones
*Attorney, Agent, or Firm*—Wall and Roehrig

[57] ABSTRACT

A faster more efficient cutter link for a saw chain is provided by contouring the toe portion to have several cutting edges spaced apart by non-cutting areas so that smaller chips are formed which can be more easily broken up and moved from the saw kerf. The cutting surfaces can be arcuate or linear and can extend all the way across the saw kerf or only part way, depending upon the particular configuration desired.

7 Claims, 3 Drawing Sheets

ROUGHING CUTTER FOR SAW CHAIN

BACKGROUND OF THE INVENTION

This application is a continuation-in-part of my prior co-pending application, Ser. No. 462,757, filed Jan. 10, 1990 now abandoned.

This invention relates to cutter links for mounting on saw chains, and more particularly to a cutter link for chainsaws used to cut wood.

PRIOR ART

Cutter links of the prior art have generally fallen into one of two classifications, namely "chipper" teeth and "chisel" teeth. These prior art designs have utilized a cutter geometry for many years in which a continuous cutting edge is provided across the toe and around and down into the shank portion of the tooth. The "chipper" teeth have generally taken a cross-sectional configuration somewhat like that shown in FIG. 1. The chipper cutting edge shown in FIG. 1 has been very popular because it can be easily sharpened by a person without any particular training or skill, however, it has a relatively inefficient cutting action, particularly in soft wood, and has a relatively slow cutting rate.

The "chisel" tooth configuration, as shown in FIG. 2, has an outwardly and upwardly extending shank portion and a flat toe portion meeting at a sharp angle forming a continuous cutting edge that is relatively more efficient and has a faster cutting rate than the "chipper", but is much more difficult to sharpen. This latter generally has limited its use to applications where professional sharpening can be justified.

In both types of prior art, cutter links or teeth, a continuous chip is cut from the wood extending across the toe and down the shank of the tooth to a depth set by the depth gauge of the chainsaw. This depth generally has been in the neighborhood of thirty to forty thousandths, and produces a rather thick, substantial mass chip, that resists separation and fracturing during cutting. This solid, large chip restricts the cutter action making for a relatively inefficient material removal from the cutting area and slowing the rate of cutting.

A further limitation of the prior art cutters is that they tend to wander from one side to the other as a large tree or log is being cut, unless the operator is skilled and careful in the direction of the chainsaw. The prior art device of FIG. 3 has been suggested (U.S. Pat. No. 3,376,906, issued Feb. 15, 1966) as a possible method of improving tracking by providing a recess in the toe of the tooth to provide a ridge or track that will help to guide the teeth and maintain them in alignment as the saw is worked into the kerf of the log. The tooth of FIG. 3 still removes a full width chip of wood down to the depth established by the depth gauge of the chainsaw, and has not overcome the foregoing deficiencies of the prior art cutter links.

OBJECTS AND SUMMARY OF THE INVENTION

Accordingly, it is an object of the present invention to provide a cutter link for use on saw chains that overcomes the limitations of the prior art devices.

It is another object of the present invention to provide a cutter link for saw chains that is more efficient and has a faster cutting rate than prior art devices.

It is yet another object of the present invention to provide a cutter link which cuts and removes multiple small chips in the space where one single chip was previously formed.

It is still a further object of the present invention to provide a cutter link for a saw chain in which the chips formed by the cutting action are quickly and easily removed to ease the movement of the chain through the saw kerf and to increase the efficiency of the cutting action.

These and other objectives are achieved in one embodiment of the present invention by providing a cutter link for a saw chain comprising a body portion having an integral shank portion extending outwardly therefrom and an integral toe portion extending laterally inwardly from the upper extremity of the shank portion with the toe portion having a pair of cutting edges spaced apart by a non-cutting edge that is positioned above the normal cutting depth of the saw chain. In this embodiment, the cutting edges are convex and the non-cutting edge is concave, each having approximately equal radii with the centers of curvature located in a common plane.

BRIEF DESCRIPTION OF THE DRAWING

Further objects of the invention, together with the features and advantages will be apparent from the following description of a preferred embodiment shown in the accompanying drawings, wherein.

DETAILED DESCRIPTION OF A PREFERRED EMBODIMENT

Figure 1:
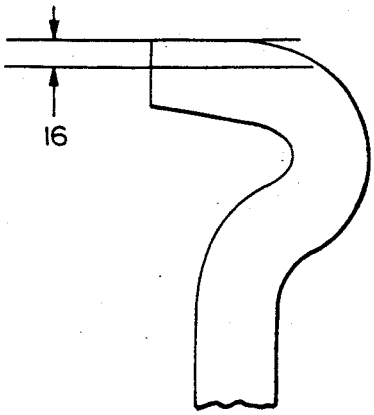
FIG. 1 Prior Art
FIG. 1 shows a conventional chipper link or tooth of the prior art.
Figure 2:
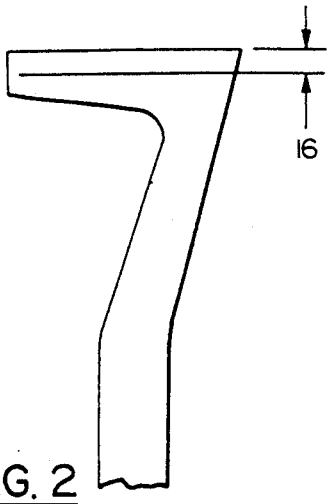
FIG. 2 Prior Art
FIG. 2 shows a conventional chisel tooth of the prior art.
Figure 3:
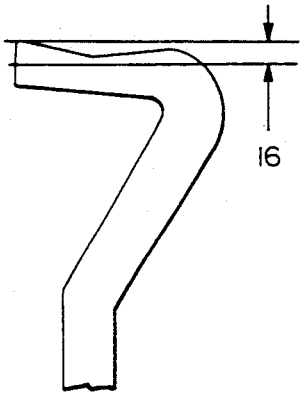
FIG. 3 Prior Art
FIG. 3 shows a conventional tooth with concave toe for improved tracking of the prior art.
Figure 4:
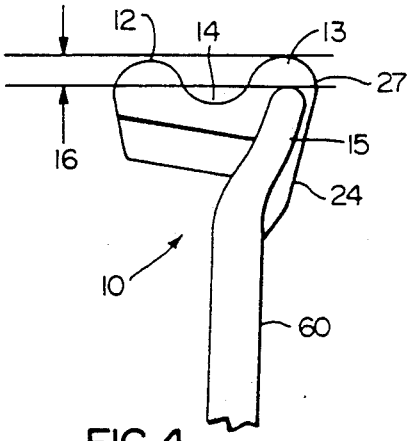
FIG. 4 is an enlarged, partial front elevation of a cutter link according to the present invention showing the relationship between the cutter tooth and the integral depth gage according to the invention.
Figure 5:
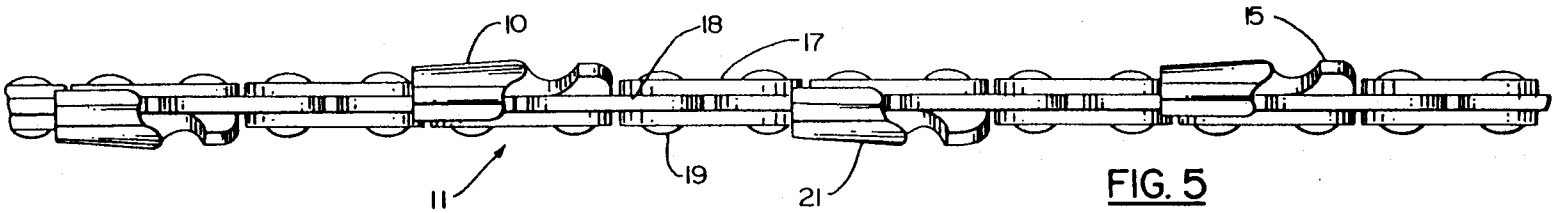
FIG. 5 is a top plan view of a section of saw chain having cutters according to the invention.
Figure 6:
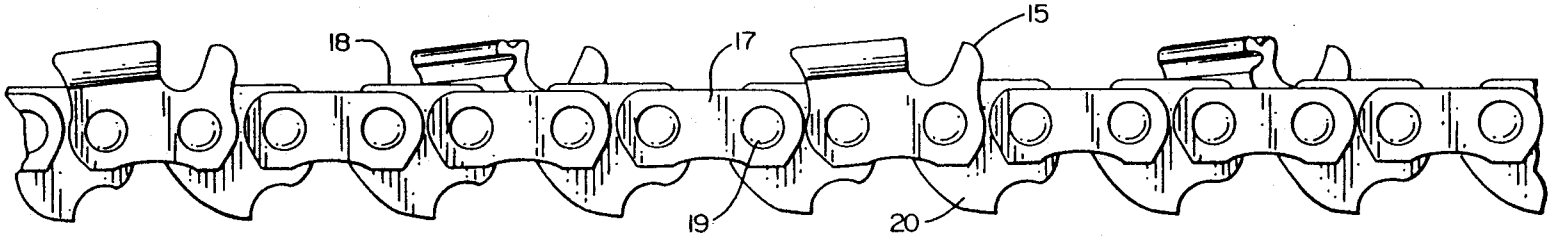
FIG. 6 is a side elevation view of the saw chain shown in FIG. 5.
Figure 10:
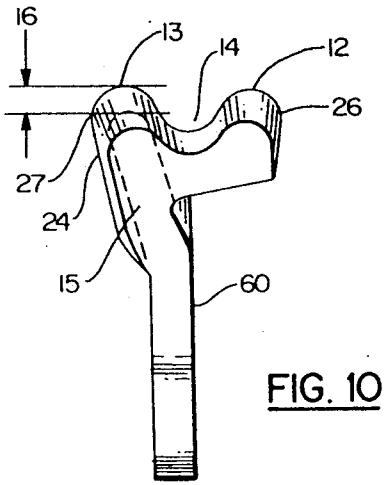
FIG. 10 is a rear view of the left hand side cutter tooth shown in FIG. 7.
Figure 9:
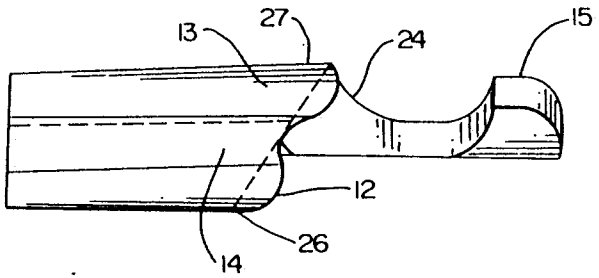
FIG. 9 is an enlarged top plan view of the cutter tooth shown in FIG. 7.

Referring now to FIG. 4, there is shown a front view of a cutter link 10 suitable for use on a chain, as will be described herein, which includes cutting edges 12 and 13 and clearance edge 14. An integral depth gage 15 determining depth of cut 16 forms part of the link 10. In FIGS. 5 and 6 there is shown a saw chain 11 according to this invention. The chain is comprised of laterally spaced pairs of side link plates 17 hingedly connected to alternately arranged center link plates 18 by means of rivets 19. Extending downward in FIG. 6 from the center links are projections 20 to be used in engaging the driving mechanism of a chain saw. Cutter links 10 and 21 are respective left and right hand cutters, identical with each other but in allochiral relationship. Integral with each of the cutter links is a depth gage 15, which is approximately 0.040 shorter than the highest point on the toe surface, allowing for a depth of cut 16. (FIG. 4)

In FIGS. 7–10 there are shown, in enlarged scale, cutter link 10 having depth gage 15 formed on the forward portion of the body 60. The cutter link 10 comprises a generally flat body portion 60 having a pair of spaced holes 23 to receive rivets (not shown). Integral with the rearward portion of the body 60 is a shank portion 24. An integral toe portion 25 extends laterally inwardly from the upper of the shank portion 24 and terminates in an edge or tip 26. In one embodiment of this invention the toe portion 25 is sufficiently wide so as to extend beyond the median plane of the saw chain 11 of which the cutter is a part, a distance sufficient to overlap the toe portion of the opposite cutter by approximately ⅓ the full toe width as measured from the shank extremity 27 to the toe edge 26. It is also possible to arrange the various cutter teeth of a saw chain with other chain completing parts or cutter configurations in such a way that the toe portion may be narrower if desired.

Figure 7:
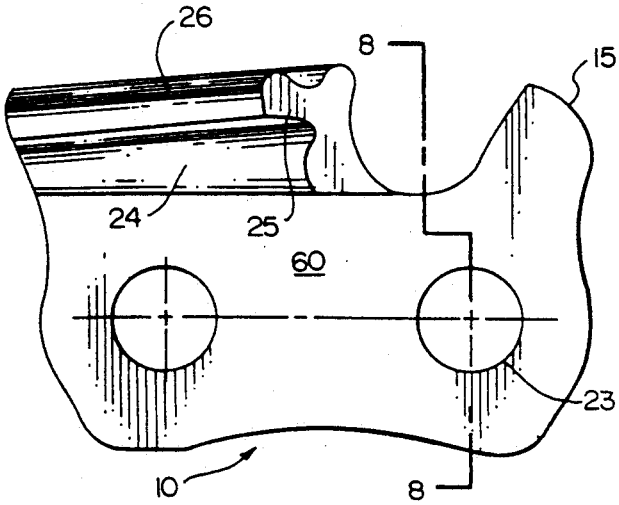
FIG. 7 is an enlarged view of a left hand cutter link or tooth of the chain shown in FIGS. 5–6.
Figure 8:
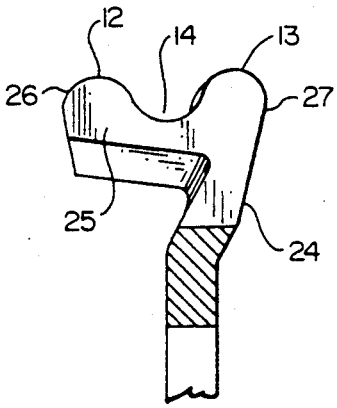
FIG. 8 is a view of the cutting face of the tooth as seen from the line 8—8 of FIG. 7.

The outer surface 27 of the aforementioned shank portion 24 is joined to the aforementioned toe portion 25 by a first convex surface 13, the radius of which is approximately 1/6 of the full toe width as measured from the shank extremity 27 to the toe edge 26. This first convex surface 13 is joined by a concave surface 14, the radius of which is approximately equal to the radius of surface 13 and whose center is on approximately the same plane as the center of surface 13. A second convex surface 12, the radius of which is approximately equal to the radius of surface 13, and whose center is on approximately the same plane as those of 13 and 14, joins the concave surface 14 to the toe edge 26. The entire toe portion 25 trails inwardly toward the shank from the toe edge 26 at an angle of approximately 7° and the shank portion 24 trails laterally inwardly from the point 27, as shown in FIG. 7, at an angle of about 3°. The forward face of the cutter tooth is sharpened as per techniques used in prior art, to form the working surface and cutting edge thereof. The edges actually exposed to cutting action are those on the mid to upper extremities of the convex surfaces 12 and 13 of the toe portion and at the outer surface of the shank portion 24 as determined by the depth gauge 15. The concave surface 14 which may take the form of a notch or groove serves as a clearance area. It separates the convex surfaces 12 and 13 and the cutting edges thereof with a clearance edge doing little or no cutting at all.

In the preferred embodiment shown in the drawings, a plane formed by the centers of the concave and convex surfaces of the toe portion is generally perpendicular to the plane of the body portion of the cutter link. It is also possible to incline the toe portion upwardly or downwardly so that this plane forms an angle of other than 90° without departing from the scope of the invention. Also, the type, quantity, and geometry of the surfaces may be varied without departing from the scope of this invention, as long as the cutting surface is not continuous across the full width of the toe and the cutting edges are spaced a clearance edges.

Figure 11:
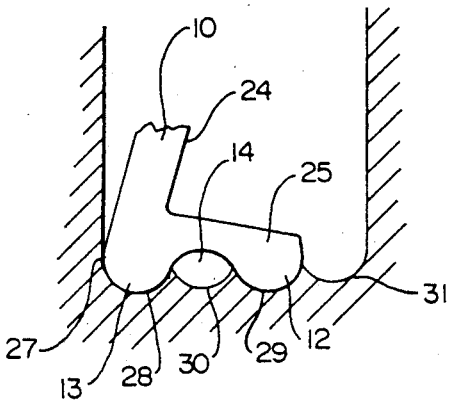
FIG. 11 is a view of a first cut in a kerf made by the leading cutter in a sequence of two cutters, one left hand, and one right hand.
Figure 12:
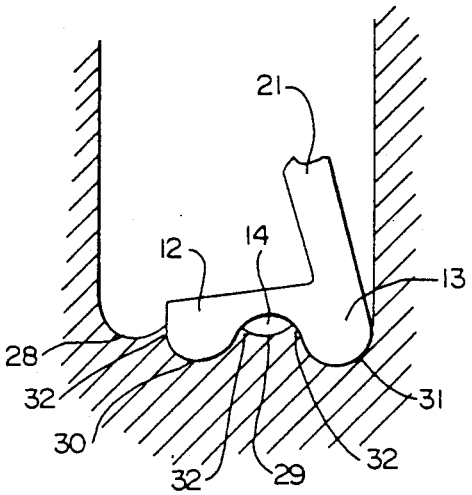
FIG. 12 is a view of a cut made by the second of a sequence of two cutters in the kerf shown in FIG. 11.

Referring now to FIGS. 11 and 12, the cutting action of a pair of left and right hand cutters is shown. Left and right is determined as the kerf would be viewed at the underside of the chainsaw bar and from the chainsaw engine. The first cut is made, as shown in FIG. 11 with left hand cutter 10. According to the present invention, two concave grooves 28 and 29 are cut into the kerf bottom by the two convex cutting surfaces 13 and 12 on the cutter toe 25. Similarly, as may be seen in FIG. 12, the following right hand cutter 21 cuts two concave grooves 30 and 31 conforming to the two convex cutting surfaces 12 and 13 on the cutter toe 25 of the right hand cutter link 21. Groove 30 overlaps mid-way between the grooves 28 and 29 cut by the left hand cutter. In prior art cutters, full cutter tooth width cuts are made with each cutter tooth to a depth allowed by the depth gage, forming full width chips of approximately the same thickness as the depth gage setting. These full width chips expand when removed from the base material and resist fracturing and compression causing inefficient chip removal and higher power requirements. The chips formed by the two separate cutting surfaces 12 and 13, since they are independent from each other are smaller and can expand freely in the clearance area. They will each have a lower fracture strength and improved compressibility than full width chips, resulting in an overall improvement in cutting efficiency, cutting speed, and also lower power requirements. As can be seen from FIGS. 11 and 12, each chip will be approximately one-half the size of prior art chips. Since the chips are so much smaller, they can be "fractured away" from the bottom of the kerf and removed entirely from the kerf much more easily, as well as faster than heretofore possible. Since each cutter requires less energy, the overall efficiency and speed of cutting of the saw chain increases dramatically. Although the surface formed by the overlapping cutting surfaces 12 and 13 of cutters 10 and 21 may be somewhat rougher than surfaces produced by prior art cutters due to the ridges 32 formed between the overlapping cutting surfaces of cutter teeth, the faster, more efficient and safer cutting will be realized.

Figure 13:
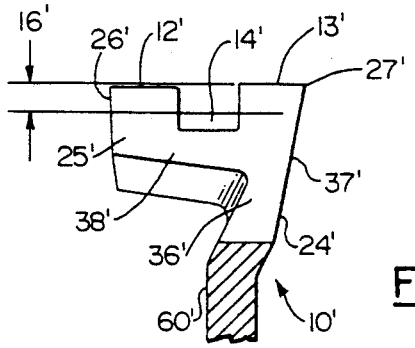
FIG. 13 is a fragmentary end view of a left hand cutter tooth illustrating another embodiment of the invention.
Figure 14:
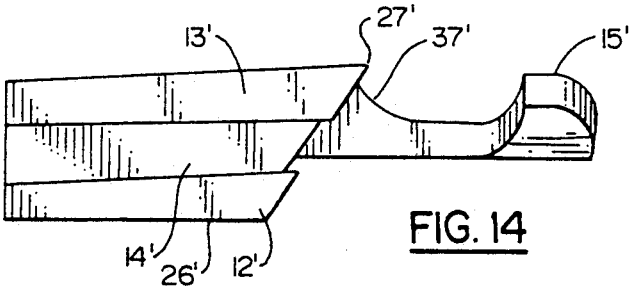
FIG. 14 is a top plan view of the cutter and its depth gage of the embodiment of the invention shown in FIG. 13.

Referring now to FIGS. 13 and 14, there is shown another embodiment in the form of a cutter, generally designated 10'. This cutter is substantially the same as the cutter 10, the difference being in replacing the concave and convex surfaces with surfaces constructed using straight lines. Here the shank 24' extends laterally outward from body 60' and a toe 25', extends transversely inwardly over the body in the same manner as does the toe 25 in FIG. 8. A front beveled face 36' of the shank trails laterally inwardly from the leading or cutting edge 37' of the shank and the surface 36' is continuous with a beveled toe surface 38'. The depth of cut 16, as determined by the depth gage 15', again provides for two cutting surfaces 12' and 13' separated by a clearance groove 14'. In forming the kerf, the cutter 10' forms two flat bottom grooves, which when followed by a cutter on the opposite side of the kerf, will overlap with substantially the same results as indicated in FIGS. 11 and 12.

While this invention has been described in the specification and illustrated in the drawings with reference to a preferred embodiment, it will be understood by those skilled in the art that various changes may be made and equivalents may be substituted for elements of the invention without departing from the scope of the claims.

What is claimed is:

1. In a chain saw of the type having individual left and right hand cutter teeth mounted in a saw chain for cutting wood, the method of removing material from the saw kerf comprising:

passing a saw chain having a plurality of left and right hand cutter teeth across the object to be cut;

causing the left hand cutter teeth to remove at least two chips of material from the kerf spaced apart by an uncut chip throughout the left side thereof, said left side being less than the full kerf width;

causing the right hand cutter teeth to remove at least two chips of material from the kerf spaced apart by an uncut chip throughout the right side thereof, said right side being less than the full kerf width;

causing the left and right hand cutter teeth to overlap sufficiently so as to remove the uncut right and left hand chips left by the opposite cutter respectively so that all material throughout the full width of the saw kerf is removed.

2. In a saw chain for chainsaws having left and right hand cutter links in allochiral relationship therealong:

first and second cutter links having a body portion adapted to be included in a saw chain as a part thereof;

a shank portion integral with said body portion extending upwardly and outwardly therefrom to an upper extremity;

an integral toe portion extending laterally inwardly from the upper extremity of said shank portion having an upper and lower surface;

said integral toe portion extending inwardly a distance greater than one-half and less than the full width of a saw kerf;

the upper surface of said first cutter link toe portion having formed therealong two equal length cutting edges and one clearance edge therebetween;

the upper surface of said second cutter link toe portion having formed therealong, in complementary fashion to said first cutter link, one clearance edge between two equal length cutting edges;

said first and second cutter links being formed so that said cutting and clearance edges are in complementary aligned relationship when positioned in a saw kerf so that one cutter link will remove the portion left uncut by the other cutter link.

3. Cutter links for a saw chain as described in claim 2 wherein said cutting edges of said first and second cutter links are convex and said clearance edges are concave.

4. Cutter links for a saw chain as described in claim 2 wherein said two cutting edges of said first and second cutter links are linear and spaced apart by said one clearance edge and said clearance edge is a rectilinear groove extending downwardly from said two cutting edges a distance greater than the depth to be cut.

5. A cutter link for a chain saw as described in claims 3 or 4 wherein said cutting edges and said clearance edges are equal in length.

6. A cutter link for a saw chain comprising:

a body portion adapted to be included in a saw chain as a part thereof;

a depth gauge portion integral with said body portion extending upwardly from one end thereof;

a shank portion having inner and outer surfaces integral with said body portion and extending upwardly and outwardly from the other end thereof to an upper extremity;

an integral toe portion having an upper and lower surface, extending laterally inwardly from the upper extremity of said shank portion to an inner longitudinal edge, the upper surface of said toe portion having formed therealong a first convex surface at the juncture of said shank and toe portions joining the outer surface of said shank portion and the upper surface of said toe portion, a concave surface joining the inner edge of said first convex surface and extending into the central toe portion, a second convex surface joining the inner extremity of said concave surface and extending to said inner longitudinal edge of the toe portion;

the leading surfaces of said shank and concave and convex toe portions being sharpened to provide two cutting edges separated by a clearance edge as governed by the depth of the concave surface and the integral depth gauge portion.

7. A cutter link according to claim 6 wherein said integral toe portion extends inwardly a distance greater than one-half and less than the full width of a kerf to be cut.

* * * * *